United States Patent [19]

Bender

[11] Patent Number: 4,895,539

[45] Date of Patent: Jan. 23, 1990

[54] UNDERWATER VIEWING DEVICE

[76] Inventor: Terry E. Bender, 9337 Bellewood St., Palm Beach Gardens, Fla. 33410

[21] Appl. No.: 235,278

[22] Filed: Aug. 23, 1988

[51] Int. Cl.[4] ..... B63C 11/00

[52] U.S. Cl. ..... 441/135; 114/66; 350/319

[58] Field of Search ..... 114/66, 270, 345; 441/135; 350/319, 544, 540

[56] References Cited

U.S. PATENT DOCUMENTS

| | | | |
|---|---|---|---|
| 1,258,324 | 3/1918 | Egenes . | |
| 1,810,302 | 6/1931 | Stiles | 350/319 |
| 2,343,473 | 3/1944 | Pierson . | |
| 2,404,556 | 7/1946 | Wirth | 350/319 |
| 2,712,139 | 7/1955 | Kelly | 114/66 |
| 2,717,399 | 9/1955 | Backhouse | 441/135 |
| 2,730,921 | 1/1956 | Little . | |
| 2,746,194 | 5/1956 | Lonnman . | |
| 2,911,878 | 11/1959 | Vernier . | |
| 3,081,726 | 3/1963 | Betts et al. | 114/66 |
| 4,145,783 | 3/1979 | Rhodes | 114/66 |
| 4,228,751 | 10/1980 | Robertson et al. | 114/66 |
| 4,548,148 | 10/1985 | Bloomfield | 114/61 |
| 4,691,658 | 9/1987 | New et al. | 441/135 |

FOREIGN PATENT DOCUMENTS

| | | | |
|---|---|---|---|
| 2537436 | 1/1977 | Fed. Rep. of Germany | 441/135 |
| 883317 | 1/1942 | France | 440/26 |
| 1254432 | 8/1961 | France | 114/66 |
| 221991 | 9/1987 | Japan | 114/270 |

*Primary Examiner*—Sherman D. Basinger
*Assistant Examiner*—Thomas J. Brahan
*Attorney, Agent, or Firm*—Cornelius J. Husar

[57] ABSTRACT

The invention relates to an underwater viewing device wherein a viewer can immerse the lower portion thereof into a body of water and view clear, undistorted images of objects which appear immediately below the underwater viewing device. The underwater viewing device is provided with a viewing tube having a plurality of opaque sides that project upwardly from a horizontal planar surface made of clear plexiglass. The opaque sides rise upwardly at a forty-five degree angle relative to the horizontal planar surface. This viewing tube is open at the uppermost end and permits viewers to look therein without the requirement of placing their head into contact with the viewing tube. Additionally, the viewing tube is not required to be covered as in prior art devices. The basic concept of the underwater viewing device is embodied in a hand held unit while there are also disclosed other applications such as air mattresses, inflatable boats and catamaran-type paddle-wheel boats.

11 Claims, 2 Drawing Sheets

FIG. 1
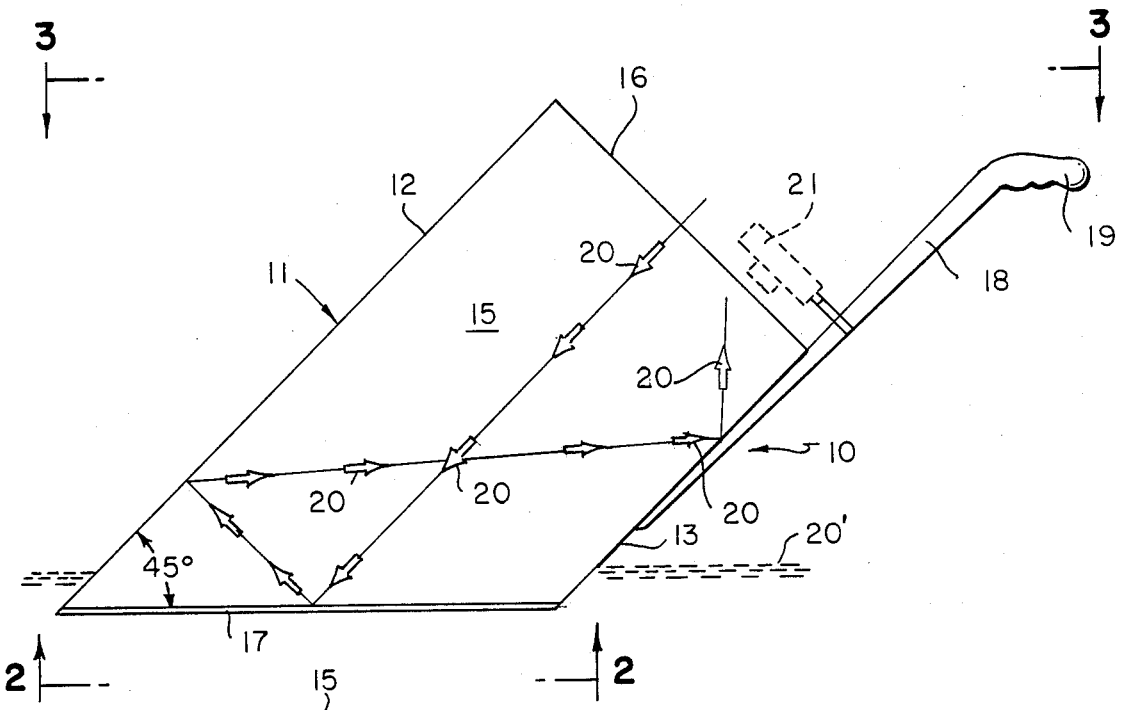
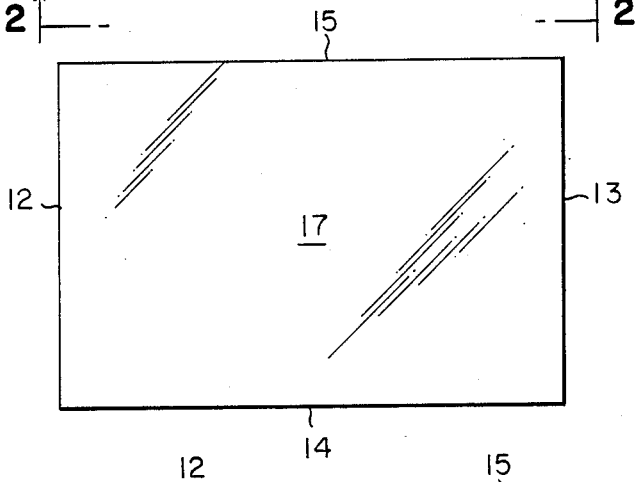
FIG. 2
FIG. 3
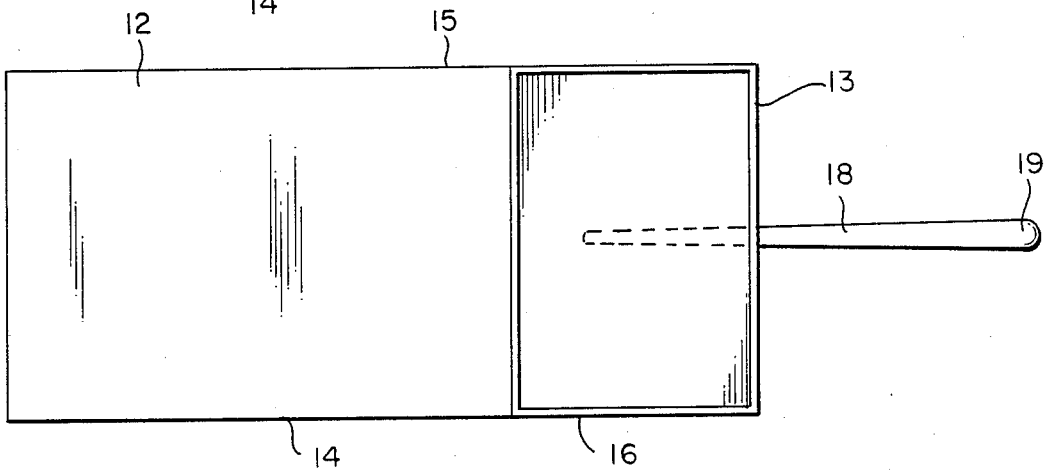

UNDERWATER VIEWING DEVICE

BACKGROUND OF THE INVENTION

Over the years there has always been a desire by man to conquer the unknown. This desire has expressed itself in many different ways. For example, since the launching of the first unmanned spaced vehicle there has been a tremendous interest in space activities by scientists, adults of all ages and even young children in the high schools and grammar schools throughout the nation.

Space activity is only one area of recent interest, another area is oceanography. Oceanography is a study of the oceans and the environment in the ocean, including the waters, depths, beds, plants, fish, etc. As anyone who has visited the ocean beaches on a summer vacation has witnessed, the beaches are full of young explorers peering into the water as the waves break upon the shores. Some are sifting the sand, others are cavorting about in the shallow water with their goggles and snorkling tubes trying to get a view of what really lies below the surface of the water.

Apparently a realization of this interest in the oceans, lakes, rivers, etc. has already taken place. The basis for this statement is due to the many underwater viewing devices which have been designed in recent years. A study of these devices reveals some serious deficiencies, which most likely serve as the reason why they have not received universal acceptance. The interest in quality underwater viewing devices is certainly there. However, not a single one of the known devices has received the universal acceptance required to make it successful.

The main problem with any underwater viewing device is the fact that distorted images appear in the device when viewed by the viewer. If the viewing area is unshielded from the incoming light, distorted images will appear. In an attempt to remove the distortions, some designers have resorted to providing opaque enclosures which will prevent the light from coming into the viewing device at any angle except the entrance of the viewing tube. However, there is a serious drawback associated with these types of known devices, i.e. all of these devices require that the viewer bring his head into contact with the uppermost end of the viewing tube to prevent the entry of light through the uppermost end thereof. As one can readily recognize, such a device permits only singular viewing, i.e. only one person can experience of joy of viewing the depths of unknown waters at any given time.

SUMMARY OF THE INVENTION

It was with the above noted facts in mind that applicant was motivated to develop the subject underwater viewing device. After many months of development, it was found that a device with an opaque shield positioned at a particular angle with an open uppermost end would permit one or more viewers to see a totally undistorted view of what is below the surface of the water without requiring the viewer to place his head into close contact with the viewing tube to prevent the entry of undesired light into the viewing tube. The only requirement associated with the subject device is that the lowermost planar surface be positioned below the level of the water which is to be viewed.

In the past there have been some underwater viewing devices which did not require the viewer to place his head into contact with the viewing device. In fact, these known devices were not provided with any tube at all to prevent the entry of light and as a result, these devices were uncapable of providing an undistorted view of the water below the viewing device.

OBJECTS OF THE INVENTION

An object of the inventin is to provide an underwater viewing device which permits underwater viewing without any distortion of the objects viewed therein.

A further object of the invention is to provide an inexpensive, portable underwater viewing device.

Another object of the invention is to provide an underwater viewing device which can be viewed from the standing or sitting position.

Yet another object of the invention is to provide an underwater viewing device which permits underwater viewing without head contact with the viewing device.

A still further object of the invention is to provide an underwater viewing device which has application in rafts, floating mattresses and paddle-wheel boats as well as a hand held viewing device.

These and other objects of the invention will become more apparent hereinafter. The instant invention will now be described with particular reference to the accompanying drawings which form a part of this specification wherein like reference characters designate the corresponding parts in the several views.

BRIEF DESCRIPTION OF THE DRAWINGS

FIG. 1 is a side elevation of the portable hand held embodiment of the underwater viewing device.

FIG. 2 is an illustration of the viewing plate per se taken along the line 2—2 of FIG. 1.

FIG. 3 is a top plan view in reduced scale, of the viewing device as indicated by the line 3—3 of FIG. 1.

DETAILED DESCRIPTION OF THE DRAWINGS

Figure 4:
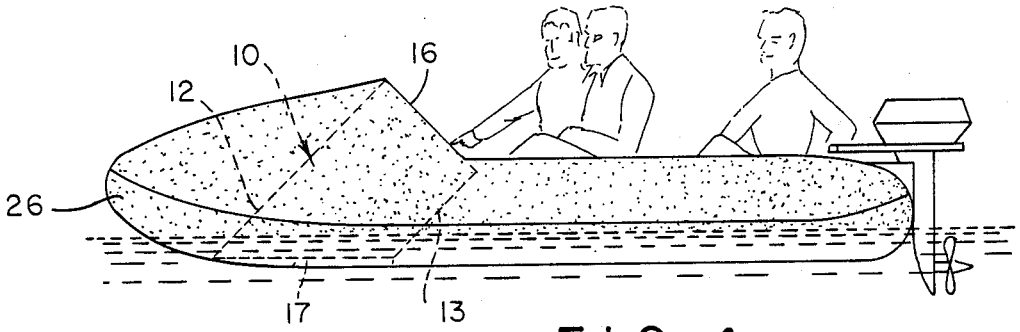
FIG. 4 is a side elevational view wherein the viewing device has been mounted in an inflatable power boat.

FIG. 1 is a side elevational view of the underwater viewing device generally indicated by the reference numeral 10. As illustrated in FIG. 1, the underwater viewing device comprises a rectangular viewing tube 11 having four parallel sides 12, 13, 14 and 15. As illustrated in FIG. 1, side 14 has been removed to permit a clear understanding of the path for light entering viewing opening 16 at the uppermost end thereof. All four sides 12, 13, 14 and 15 are made of an opaque material. The lowermost end of sides 12, 13, 14 and 15 are enclosed by a horizontal planar sheet 17 of clear plexiglass material. All four sides 12, 13, 14 and 15 are secured together with appropriate fastening means (not shown) and provided with a bead of sealant in the interior corners were the sides meet (also not shown). The purpose of the sealant is to prevent water from leaking into the interior of the viewing tube 11. An additional bead of sealant is provided in the interior of viewing tube 11 around the line where each side meets horizontal planar sheet 17 to provide an extra measure of leakproofing. Attached to the center of side 13 is handle 18 which is securely mounted thereto. It is to be noted that handle 18 is provided with a grip portion 19 at its distal end. It is to be further noted that sides 12, 13, 14, and 15 are inclined at an angle of forty five degrees relative to vertical and also horizontal planar sheet 17. Arrows 20 indicate the path of incoming light into viewing tube 11. As shown by arrows 20, light enters viewing opening 16 and impinge upon horizontal planar sheet 17, bouncing off planar sheet 17 at a right angle thereto and impinging on side 12 where it again bounces off at a right angle striking side 13 and then bouncing off at a right angle out viewing opening 16 without returning to the viewers eyes. It is this novel angular relationship sides 12, 13, 14 and 15 relative to horizontal planar sheet 17 that provides the unique results heretofore unattainable i.e. an undistorted view of what lies below the surface of the water 20.

The orientation of grip portion 19 is such that a person in standing position may comfortably hold grip portion 19 and merely, by ensuring that horizontal planar sheet 17 is below the surface of the water 20, a clear, undistorted view of what lies below horizontal planar sheet 17 will appear in viewing tube 11. As indicated previously, there is no need for the viewer or viewers to have their heads come into contact with the uppermost end of viewing tube 11, thus permitting more than one person to simultaneously enjoy the depths of the unknown waters.

Attached to handle 18 is a camera 21 which is an accessory not forming a part of the subject invention. However, the camera 21 may be attached to handle 18 when used by an adult or other person capable of making use of same to photograph the mystery of the waters.

FIG. 2 is a view taken along the line 2—2 of FIG. 1, illustrating the relative dimensions of horizontal planar sheet 17.

FIG. 3 is a plan view on reduced scale, looking down upon the underwater viewing device 10 as indicated by the plane 3—3 of FIG. 1. The illustration of FIG. 3 does not show the mounting of camera 21 which is an optional addition to underwater viewing device 10.

Referring now to FIG. 4, there is shown a side view of an inflatable power boat 25 wherein the underwater viewing device 10 has been mounted in the bow 26. Viewing device 10 is provided with opaque sides 12, 13, 14 and 15 forming the viewing tube 11. Opening 16 is provided at the uppermost end of sides 12, 13, 14 and 15 with sides 12 and 13 positioned at a forty-five degree angle relative to plexiglass planar sheet 17 in the same manner as the hand held embodiment of FIG. 1.

Figure 5:
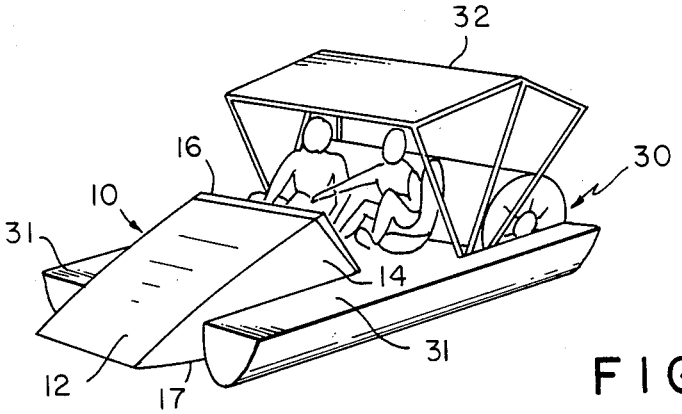
FIG. 5 is a perspective view showing how the viewing device can be adapted to catamaran-type paddle boat.

Referring now to FIG. 5, there is an illustration of how the concept of the invention can be applied to a catamaran-type paddle wheel boat 30. As illustrated, the underwater viewing device 10 is illustrated as being of larger scale than the hand held embodiment of FIG. 1. Underwater viewing device 10 is positioned between tanks 31. A collapsible awning 32 is located above the occupants of the boat 30. However, it is to be noted that awning 32 is solely for the purpose of protecting the occupants of the boat from the hot sun above. Awning 32 is not for the purpose of preventing light from entering viewing opening 16. As pointed out above, applicant's viewing device, due to the angular relationship of sides 12 and 13 (not seen in this fig.) with respect to horizontal planar sheet 17 does not require that the overhead area of viewing opening 16 be covered as required with prior art devices.

Figure 6:
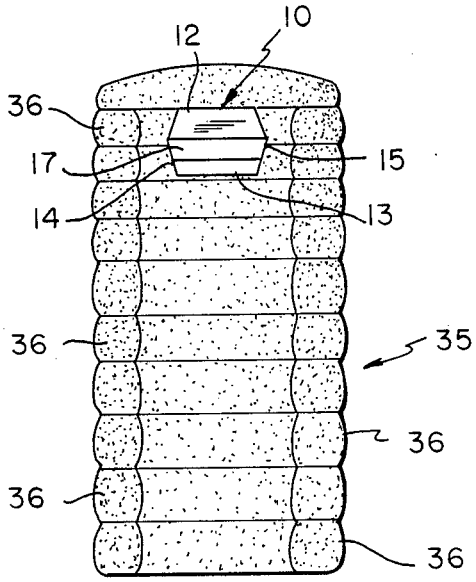
FIG. 6 is a plan view of an inflatable mattress wherein the viewing device has been incorporated therein.

Referring now to FIG. 6, there is shown a plan view of an inflatable mattress 35 which is also provided with the underwater viewing device of FIG. 1. Opaque sides 12, 13, 14 and 15 are also visible in this view. Again, the inclination of opaque sides 12 and 13 is forty five degrees relative to horizontal planar sheet 17. As illustrated, mattress 35 is provided with the usual compartments 36 which are inflated to form the mattress 35. These are only a few of the many possible applications of the concept of the subject invention.

While the invention has been described in the preferred embodiments, it is to be understood that the words which have been used are words of description rather than limitation and that changes may be made within the purview of the appended claims without departing from the full scope or spirit of the invention.

Having thus described my invention, I claim:

1. An underwater viewing device comprising horizontal transparent viewing means; a viewing tube operatively connected to and extending upwardly from said horizontal transparent viewing means, said viewing tube having a plurality of opaque sides forming a viewing opening at the uppermost ends thereof, said viewing opening being perpendicular to said plurality of opaque sides and also being of lesser area than said horizontal transparent viewing means; each of said opaque sides securely attached to each other and provided with sealant means at the junction points of said opaque sides with each other and also with said horizontal transparent viewing means; said opaque sides forming said viewing tube having an angle of less than ninety degrees with said horizontal transparent viewing means; support means securely fastened to at least one of said plurality of opaque sides to provide support for said underwater viewing device whereby said horizontal transparent viewing means can be immersed in water permitting one or more viewers to look into said viewing opening and see clear, undistorted images of what lies below said horizontal transparent viewing means without the requirement for the viewer to place his head into contact with said viewing tube at the open end thereof.

2. An underwater viewing device of the character described in claim 1 wherein said horizontal transparent viewing means is a sheet of clear plexiglass material.

3. An underwater viewing device of the character described in claim 1 wherein said support means comprises handle means secured to one of said opaque sides of said viewing tube.

4. An underwater viewing device of the character described in claim 3 wherein said handle means includes a hand grip portion provided with a plurality of finger grooves which will receive the fingers of a person gripping the handle as they wrap therearound.

5. An underwater viewing device of the character described in claim 1 wherein said angle of less than ninety degrees is forty five degrees.

6. An underwater viewing device of the character described in claim 1 wherein said support means comprises the hull structure of an inflatable power boat with said underwater viewing device integrally positioned in the bow portion thereof to permit the occupants of said boat to view the images below the surface of the water.

7. An underwater viewing device of the character described in claim 1 wherein said support means comprises a pair of spaced floatation tanks of a catamaran-type paddle wheel boat with said underwater viewing device integrally positioned at the bow thereof between said pair of spaced floatation tanks.

8. An underwater viewing device of the character described in claim 1 wherein said support means comprises integral portions of an inflatable mattress with said underwater viewing device at the forward end thereof whereby a person lying in the prone position may comfortably view the images which appear in the viewing tube.

9. An underwater viewing device of the character described in claim 1 wherein said opaque sides are made of a dark plastic material to reduce the weight of the device and prevent light from entering therethrough.

10. An underwater viewing device of the character described in claim 1 wherein said sealant means is a bead of sealant which will prevent water entering therein.

11. An underwater viewing device of the character described in claim 1 wherein said plurality of opaque sides comprises four sides with each side positioned at right angles to each adjacent side.

* * * * *